United States Patent [19]

Coon

[11] 4,274,797

[45] Jun. 23, 1981

[54] BACKHOE EXCAVATING APPARATUS

[76] Inventor: David B. Coon, 8262 Michael Dr., Huntington Beach, Calif. 92647

[21] Appl. No.: 51,716

[22] Filed: Jun. 25, 1979

[51] Int. Cl.[3] ..... E02F 3/75

[52] U.S. Cl. ..... 414/694; 414/705; 414/718

[58] Field of Search ..... 414/694, 705, 718; 92/2

[56] References Cited

U.S. PATENT DOCUMENTS

| | | | |
|---|---|---|---|
| 2,927,706 | 3/1960 | Mork | 414/694 |
| 3,135,403 | 6/1964 | Przybylski et al. | 414/718 |
| 3,396,860 | 8/1968 | Witwer et al. | 414/718 |
| 3,700,126 | 10/1972 | Beaton | 414/718 |
| 3,871,538 | 3/1975 | Miller et al. | 414/718 |
| 4,049,139 | 9/1977 | Stedman | 414/694 |

FOREIGN PATENT DOCUMENTS

| | | | |
|---|---|---|---|
| 1153254 | 8/1963 | Fed. Rep. of Germany | 92/2 |

*Primary Examiner*—Leslie J. Paperner
*Attorney, Agent, or Firm*—Philip D. Junkins

[57] ABSTRACT

In a backhoe type of excavating apparatus comprised principally of: a main arm or mast fulcrumed at one end from a rear platform of a tractor; a second hydraulically articulated arm, or so-called dipper stick, supported by and pivoted on the free end of the main arm; and a trenching or digging bucket pivotally attached to the free end of the dipper stick and being hydraulically articulated to provide a swinging or curling motion thereto, an improved dipper stick constructed of telescoping sections for extending or shortening the length thereof in response to an internally contained hydraulic actuator and including at its mast supported end a hydraulic rotator assembly whereby the dipper stick (and attached digging bucket) may be rotated over approximately 150° in each direction from its normal vertical orientation.

3 Claims, 5 Drawing Figures

BACKHOE EXCAVATING APPARATUS

BACKGROUND OF THE INVENTION

This invention relates generally to excavating machinery and, more particularly, to tractor-mounted backhoe apparatus principally including an articulated boom mounted pivotally at one end to the rear of a tractor and a digging or trenching bucket carried by the boom at its free end. It is common in such backhoe apparatus that the articulated boom is comprised of a main arm or mast and a second arm, frequently referred to as a dipper stick, to which the digging bucket is pivotally attached. Thus, the main arm is fulcrumed at one end to a tractor mounting and at its free end supports the second arm of the boom through a horizontal pivot. The bucket, in turn, is mounted to swing, via a further horizontal pivot, at the free end of the second arm (dipper stick). In such arrangement vertical movement of the bucket is commonly accomplished through the use of hydraulic drives (cylinders and piston-type drive rods). A first cylinder and rod drive combination acts between the fulcrumed-end of the main arm and a pivot on the upper end of the second arm to swing the latter toward and away from the tractor. A second cylinder and rod drive combination is fastened at one end to the upper portion of the second arm and at the other end to the bucket to rock or curl the bucket about the horizontal pivot connecting the bucket to the second arm.

SUMMARY OF THE INVENTION

The principal object of the present invention is to provide a unique pivoted secondary arm or dipper stick assembly for incorporation in conventional backhoe excavating apparatus to enable the usual digging bucket to accomplish trenching and excavating operations including sloping trench walls and/or inclined excavations.

A more detailed object of the invention is to accomplish the foregoing through the provision of novel means associated with the dipper stick arm of backhoe excavating apparatus for extending and retracting such arm and for rotating the arm (and the digging bucket pivotally depending therefrom) over as much as 150° from vertical in a clockwise direction and over as much as 150° from vertical in a counterclockwise direction. Thus, the usual digging bucket (with vertical side panels) can be pivoted from its normal vertical orientation to cut, during trenching and excavating operations, sloping trench walls or inclined excavations.

These and other objects and advantages of the present invention will become more apparent from the following detailed description when taken in conjunction with the accompanying drawings.

DETAILED DESCRIPTION OF THE PREFERRED EMBODIMENT

Figure 1:
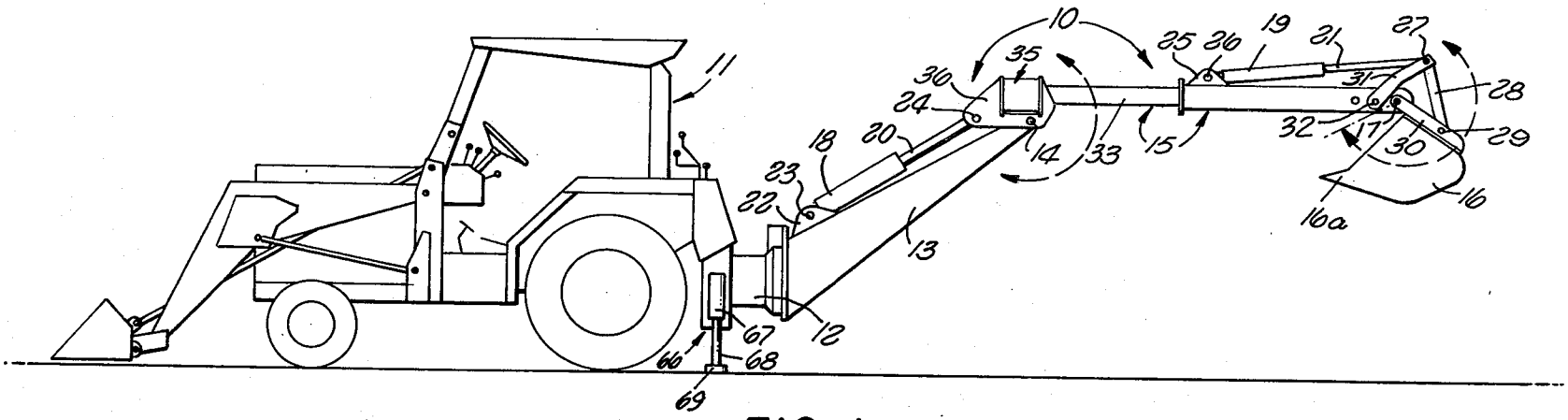
FIG. 1 is a side elevation of the backhoe excavating apparatus, embodying the features of the present invention, mounted on the rear of a tractor, showing the novel rotatable and extendable dipper stick portion of the boom and attached digging bucket in raised position.

As shown in the drawings for purpose of illustration, the present invention is embodied in tractor-mounted backhoe excavating apparatus 10 such as is designed to perform various types of excavation work including trench digging. As shown in FIG. 1 the backhoe apparatus 10 is mounted on the back of a tractor 11 by appropriate attachment to a platform 12. The details of the tractor itself are not important to this invention other than that the platform 12 may provide side-to-side rotatable support to the backhoe apparatus (with respect to the tractor) about a vertical pivot incorporated in the platform. The entire backhoe apparatus 10 may be articulated as a unit with respect to the platform, by appropriate horizontal pivotal support (not shown) incorporated in the platform and a hydraulic actuator (also not shown) extending between the platform and the lower part of the platform attachment end of the backhoe apparatus.

The tractor-mounted backhoe excavating apparatus 10 is basically comprised of: an elongated arm or mast 13 fulcrumed at its platform-mounting end on the vertical pivotal support of the platform and having a horizontal pivot 14 at its free end for pivotally supporting a second arm 15 (commonly called a dipper stick); and a digging bucket 16 mounted to swing at the outer end of the dipper stick about the generally horizontal pivot 17. With the foregoing arrangement vertical movement of bucket 16 may be accomplished through the use of hydraulic operating mechanisms including cylinders 18 and 19 and their respective reciprocating drive rods 20 and 21. The hydraulic cylinder 18 and drive rod 20 act between the platform-mounting end of arm 13, where the cylinder is attached to parallel cylinder mounts 22 (affixed to such arm) via horizontal pivot 23, and a pivot 24 on the pivot end of the dipper stick 15 to swing the latter over nearly a 180° arc toward and away from the tractor 11. The hydraulic cylinder 19 is fastened to parallel cylinder mounts 25 (mounted on the upper portion of the dipper stick 15) via horizontal pivot 26 and its drive rod 21 is connected via horizontal pivot 27, parallel link bars 28, pivot 29 and parallel bars 30 to digging bucket 16 to rock or curl the bucket (over nearly a 240° arc) about its pivot 17. The rocking or curling rotational motion of bucket 16 is assured by parallel link bars 31 which are pivoted at one end from the extended end of dipper stick 15 via horizontal pivot 32 and which at the other end provide support for horizontal pivot 27. Additional hydraulic cylinder-type actuators (not shown) may act between the platform 12 and mast or arm 13 to swing the latter upwardly and downwardly and from side-to-side to thereby further position the backhoe excavating apparatus and digging bucket with respect to the tractor and/or the terrain to be excavated or trenched.

The dipper stick portion 15 of the backhoe excavating apparatus 10 of the present invention includes additional features not heretofore incorporated in such devices. Thus, the dipper stick of the invention is extendable and rotatable providing significant additional versatility and maneuverability of the apparatus during excavating and trenching operation thereof. Extendability of the dipper stick arm 15 is accomplished through telescoping members 33 and 34 forming such arm. Rotatability of dipper stick arm 15 (and thereby digging bucket 16) is accomplished through hydraulic rotator assembly 35 incorporated into such arm at its pivot end. The hydraulic rotator assembly 35 is mechanically affixed to arm member 33 (as described in detail hereinafter with respect to FIGS. 2, 3 and 5) and to parallel dipper stick pivot plates 36 which, with dipper stick 15, rotate about horizontal pivot 14 at the free end of main arm or mast 13. The parallel pivot plates 36 connect with drive rod 20 of hydraulic cylinder 18 through horizontal pivot 24.

Figure 2:
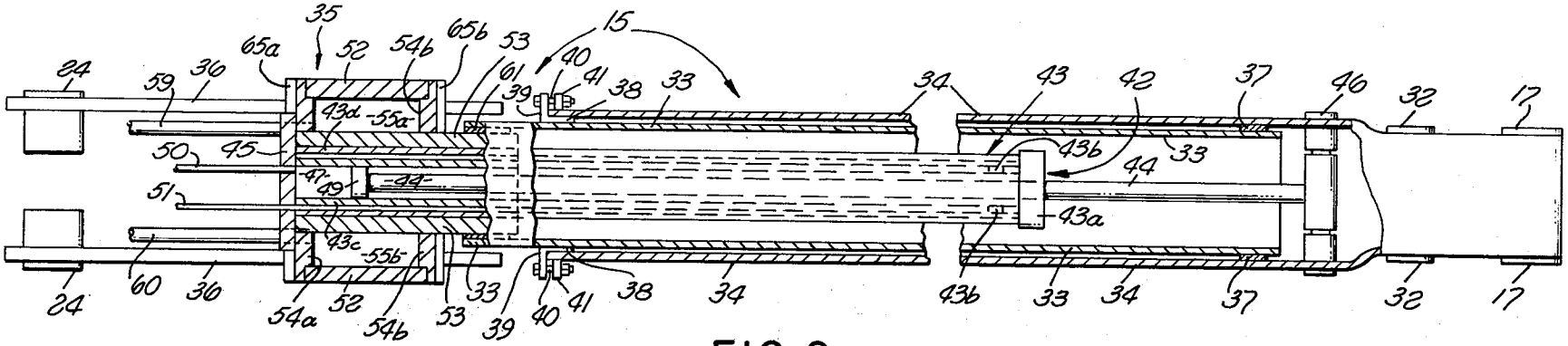
FIG. 2 is a top view, partly in cut-away section, of the novel dipper stick portion of the backhoe boom showing the internal mechanisms for extending and rotating same.
Figure 3:
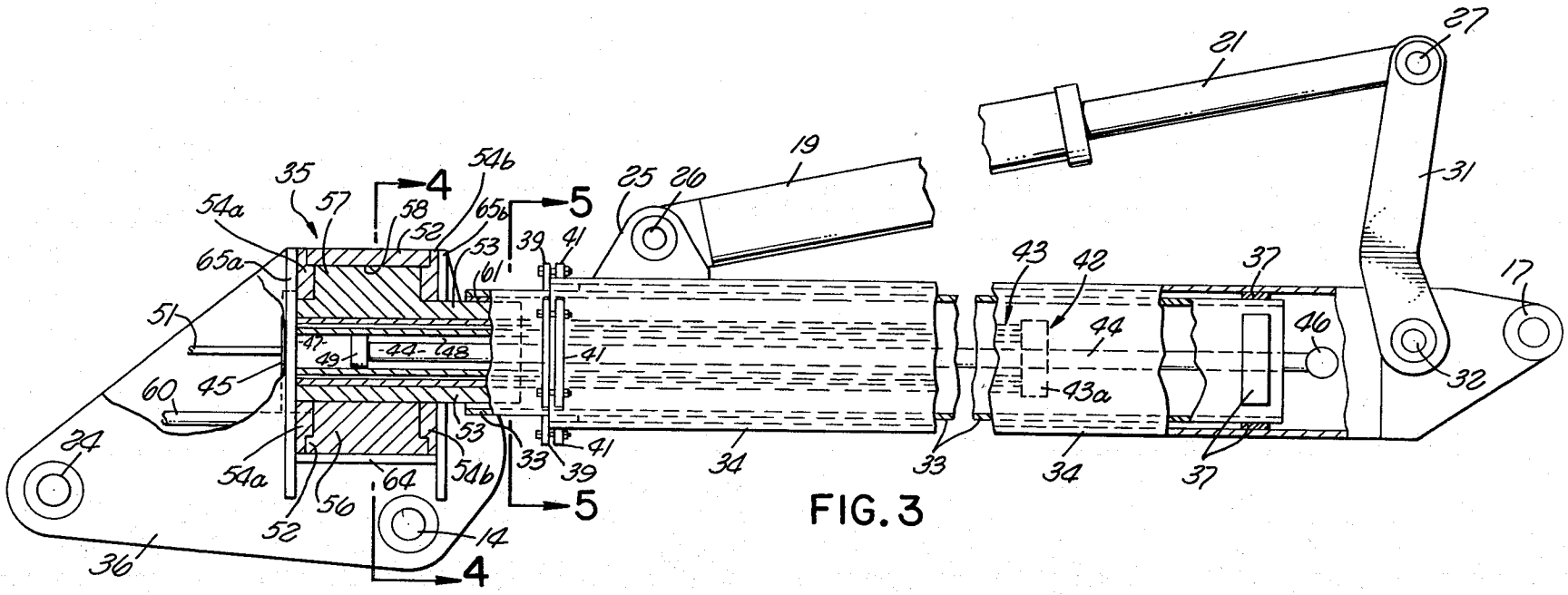
FIG. 3 is a front view, partly in cut-away section, of the dipper stick of FIG. 2.

Referring now particularly to FIGS. 2 thru 5 the second arm or dipper stick 15 of the invention is shown to comprise principally of hollow telescoping members 33 and 34. In the preferred embodiment member 33 is square in cross-section and telescopes within member 34 of larger square cross-sectional configuration. Members 33 and 34 are maintained in telescoping alignment and sliding relationship by two sets of bearing or bushing plates 37 and 38. As illustrated, each bearing plate set includes four plates with plates 37 being affixed to the extended end of member 33 on its outer surfaces for bearing contact with the inner surfaces of member 34. Plates 38 are removably affixed to the inner surfaces of member 34 (at its end nearest the hydraulic rotator assembly) for bearing contact with the outer surfaces of member 33. These bearing plates are L-shaped in cross-section, as shown in FIG. 2, and are individually inserted between the corresponding sides of dipper stick members 33 and 34 after such members have been assembled by sliding the extended end of member 33 (with plates 37) into and through a substantial portion of member 34. The L-shaped bearing plates are thereafter inserted between members 33 and 34 with the leg portion 39 of each such plate being affixed to member 34 via bolts 40 clamping the leg portions 39 of each bearing plate to a matching locking plate 41 affixed to and carried by the outer surface of member 34.

Extension and retraction of dipper stick 15 through extended and retracted telescoping of members 33 and 34 is accomplished and controlled by internally housed hydraulic actuator 42 comprised of double-wall hydraulic cylinder 43 and its associated piston driven rod 44. The hydraulic actuator 42 extends centrally through rotator assembly 35 and terminates in end plate 45 which is affixed to an end plate of the rotator assembly. Actuator 42 is connected at its drive rod end to pivot 46 which extends laterally between the side walls of member 34 near its free end whereat bucket 16 is pivotally supported. Extension of dipper stick 15 via hydraulic actuator 42 is accomplished by introducing hydraulic fluid to the space 47 within cylinder 43 between end plate 45 and piston 49 (at the driven end of rod 44) through a fluid line 50 while withdrawing hydraulic fluid from the space 48 within cylinder 43 between cylinder cap **43*a* and piston 49 through ports 43*b* in the inner wall 43*c* of cylinder 43, the annular space between inner wall 43*c* and outer wall 43*d* of cylinder 43, and fluid line 51 thus forcing rod 44 to be extended without cylinder 43 and thereby driving dipper stick member 34 away from the pivot plates 36. Retraction of dipper stick 15 is accomplished by withdrawing hydraulic fluid from space 47 through fluid line 50 while introducing hydraulic fluid to space 48 via fluid line 51 thus drawing piston 49 (and rod 44) toward end plate 45 and thereby pulling dipper stick member 34 toward the pivot plates 36**.

Rotation of dipper stick arm 15, as mentioned heretofore, is accomplished through hydraulic rotator assembly 35 incorporated into such arm at its pivot end. The rotator assembly is principally comprised of an annular housing 52, cylindrical rotator element 53 positioned internally of the housing, and rotator housing end plates **54*a* and 54*b*. The housing 52 and rotator element 53 together form an annular space 55. Housing 52 bears an internal hydraulic fluid dam 56 which extends radially throughout the length of space 55 toward and to the rotator element. The cylindrical rotator element 53 bears a wing portion 57 which extends radially throughout the length of space 55 toward and to the inner wall 58 of housing 52. By particular reference to FIG. 4 it will be seen that rotator element 53, shown in its normal position, may rotate within housing 52** over approximately 150° clockwise and 150° counterclockwise from such normal position.

The rotatable position of rotator element 53 within housing 52 is established by introducing and withdrawing hydraulic fluid from space 55 on either side of wing portion 57 forming, with fluid dam 56, sub-spaces **55*a* and 55*b*. Thus, hydraulic fluid may be introduced to sub-space 55*a* through a fluid line 59 and withdrawn from sub-space 55*b* through a fluid line 60 to move and position wing portion 57 clockwise of its normally vertical position. By introducing hydraulic fluid through line 60 to sub-space 55*b* while withdrawing such fluid from sub-space 55*a* through line 59 wing portion 57 is moved and positioned counterclockwise within annular space 55**.

Figure 5:
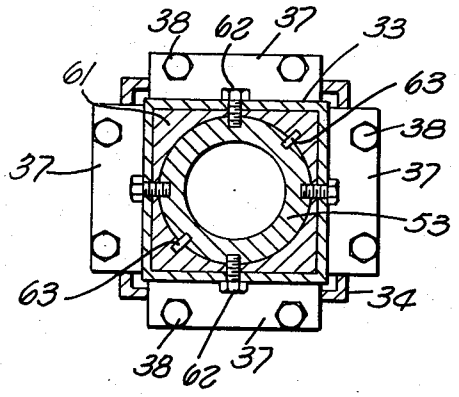
FIG. 5 is a section view of the dipper stick of FIG. 2 and FIG. 3 taken along line 5—5 of FIG. 3 showing the connection assembly between the dipper stick and the hydraulic rotator.
Figure 4:
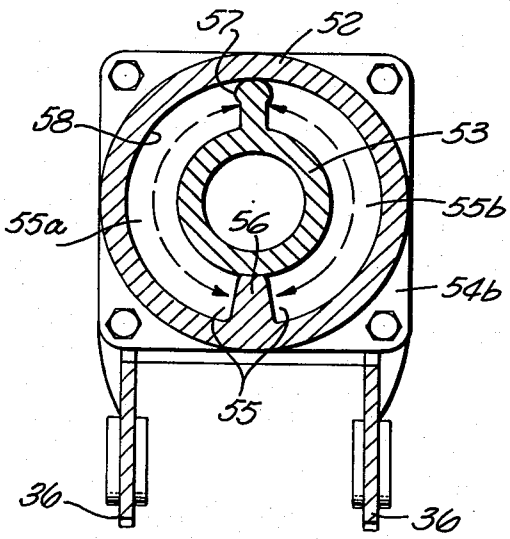
FIG. 4 is a section view of the dipper stick of FIG. 2 and FIG. 3 taken along line 4—4 of FIG. 3 showing the hydraulic rotator assembly of the dipper stick.

Rotator element 53 of the hydraulic rotator assembly 35 may be attached to dipper stick member 33 in the manner illustrated in FIG. 5. Thus, an adequate dipper stick support portion of rotator element 53 extends into dipper stick member 33 with the space between such element and such member filled by transition piece or adaptor block 61. Member 33 of the dipper stick is fastened to rotator element 53 (for rotation therewith) via fasteners 62 extending through member 33, transition piece 61 and into the rotator element 53 itself. Additional locking of rotator element 53 to transition piece 61 may be accomplished by one or more key members 63 extending between such element and the transition piece.

As previously mentioned the hydraulic rotator assembly 35 is mechanically affixed to parallel dipper stick pivot plates 36. It is further supported at the pivot end of the dipper stick arm by horizontal plate 64 which extends under the rotator assembly between pivot plates 36, and by parallel vertical plates **65*a* and 65*b* which enclose the ends of such assembly (including housing end plates 54*a* and 54*b*) and likewise extend between pivot plates 36**. Additional reinforcing members and plates may be added to the assembly of parts and devices comprising the pivot end of the dipper stick arm to provide the structural strength necessary to withstand the lifting and rotating forces applied to the arm during excavating maneuvers.

It is obvious that appropriate end seals must be applied to the hydraulic rotator assembly 35 via end plates **54*a* and 54*b* to contain the hydraulic fluid within such assembly and that the tolerances between rotator wing portion 57 and inner wall 58 of annular housing 52, and between fluid dam 56 of the housing and the rotator 53, must be such that rotation of the rotator can be effected but seepage of hydraulic fluid between sub-spaces 55***a* and 55*b* is inhibited. Likewise, all hydraulic actuators utilized in connection with the articulation movements of mast 13, dipper stick 15 and bucket 16, and the extension of the dipper stick, must be provided with appropriate hydraulic fluid seal means with respect to their cylinders and piston driven actuator rods so that positive and controlable movements of the components of the entire backhoe structure of the invention can be carried out.

In operation of the tractor and backhoe excavating apparatus, the tractor is first set and supported by a pair of legs 66 (FIG. 1) which are mounted on the rear of the tractor adjacent opposite sides of platform 12. Each of the legs includes a hydraulic cylinder 67 with one end connected to the tractor and a rod 68 extending out of the other end. Pivotally attached to the free end of each of the rods is a foot pad 69 for distributing the weight of the tractor across a relatively large area of ground. By adjusting the extent of projection of the rods 68 from the cylinders, the rear of the tractor may be leveled and supported by the legs for digging with the digging bucket 16.

Once the tractor is in position and set for excavating, first entry into the ground is accomplished by actuating the cylinders 18 and 19 to retract rods 20 and 21 and thereby straighten out and fully extend the backhoe excavating apparatus 10. At the same time, the actuator (not shown in FIG. 1) for controlling vertical movement of the main mast or arm 13 is actuated to pivot the mast toward the ground until the digging teeth 16*a* of bucket 16 strike the ground. Thereafter, the bucket 16 is curled on the end of the dipper stick 15 while the dipper stick is pivoted toward the tractor (by extension of rod 20 from cylinder 18) while the mast 13 is pivoted away from the ground to cause a load of earth to be scooped into the bucket. Repeated scooping forms the desired excavation or trench which may be widened simply by swinging the mast 13 horizontally to one side or the other and scooping alongside the previously scooped areas. One of the important advantages of the present invention relates to the extendability and retractability of the dipper stick arm. Thus, in apparatus of the general type disclosed herein, if the main mast 13 can not be raised or lowered to pivot same toward or away from the ground, essentially the same scooping action as described heretofore can be accomplished by extending the dipper stick arm to its full length at the commencement of the scooping stroke and retracting such arm as it is pivoted toward the tractor.

Digging or trenching in the above described fashions with the usual digging bucket having vertical or upright side panels (as shown in FIG. 1) results in the formation of an excavation or trench with substantially vertical side walls. Such excavations may be satisfactory for some purposes but in other instances sloping walls may be required. Through the present invention sloping trench walls or inclined excavations may be formed by a conventional digging bucket through the use of the hydraulic rotator assembly 35 provided at the pivot end of the dipper stick arm 15. Thus, actuation of such hydraulic assembly results in rotation and positioning of the dipper stick and bucket by as much as 150° clockwise and 150° counterclockwise of vertical.

The present invention is not limited to the details of the structure disclosed and described herein, but is intended to cover all substitutions, modifications and equivalents within the scope of the following claims.

What I claim is:

1. In backhoe excavating apparatus for mounting on the rear of a tractor and including a main arm fulcrumed at one end to a tractor-mount in pivotal relationship therewith, a dipper stick arm pivotally supported at one end by a horizontal pivot at the free end of said main arm and formed of elongated telescoping members which are extendable and retractable by actuator means enclosed therein, a digging bucket pivotally mounted to swing at the free end of the dipper stick arm, and actuator means carried by the main arm and by the dipper stick arm for articulating said latter arm and said bucket, an improved dipper stick arm comprising:

(a) a hydraulic rotator assembly forming the supported end of the dipper stick arm and including
  (i) a cylindrical rotator housing bearing a radial inwardly-projecting dam member extending in an axial direction along one portion of the inner annular surface thereof, and
  (ii) a cylindrical rotator element co-axially enclosed within said rotator housing and bearing a radial outwardly-projecting wing member extending in an axial direction along one portion of the outer annular surface thereof, said rotator element being mechanically connected through a portion thereof extending without said housing to the dipper stick arm to rotatably support said arm, and said wing member cooperating with the inner annular surface of said housing and said dam member cooperating with the outer annular surface of said rotator element to form two fluid tight compartments between said housing and said rotator element which are mutually expandable and contractable in response to rotational positioning of said rotator element within said housing;

(b) pivot means affixed to the housing of said rotator assembly for pivotally connecting said assembly and connected rotatably-supported dipper stick arm to the free end of the main arm of the backhoe excavating apparatus;

(c) actuator means for extending and retracting the telescoping members forming the dipper stick arm including
  (i) a hydraulic cylinder enclosed within said arm and having its closed hydraulic fluid receiving end extending through the cylindrical rotator element of the hydraulic rotator assembly,
  (ii) a piston driver actuator rod having its piston end extending into said hydraulic cylinder for positioning therein in response to hydraulic fluid introduced to or withdrawn from said cylinder and having its actuator end extending from said cylinder and through said arm for attachment thereto at its free end, and
  (iii) means associated with the closed end of said cylinder for the introduction of hydraulic fluid thereto and the withdrawal of hydraulic fluid therefrom for moving and positioning the piston driven actuator rod thereby extending or retracting said dipper stick arm; and (d) means for introducing hydraulic fluid to one compartment of said rotator assembly while withdrawing hydraulic fluid from the other compartment of said assembly to mutually expand and contract said compartments whereby said wing member of said rotator element may be rotatably actuated and maintained with respect to said dam member for turing said dipper stick (and the digging bucket pivotally mounted thereon) to and positioning same in directions clockwise and counterclockwise from their normal vertical orientation for effecting trenching and excavating operations in which sloping trench walls and inclined excavated surfaces are developed by said backhoe excavating apparatus.

2. The backhoe excavating apparatus as claimed in claim 1 wherein, the hydraulic cylinder of the activator means for extending and retracting the telescoping members forming the improved dipper stick arm is formed of concentric walls and the annular space formed between said walls is connected at the closed end of said cylinder with the means associated with the cylinder for introduction to and withdrawal of hydraulic fluid and said space is connected through ports at its actuator end with said cylinder whereby haudralic fluid for moving and positioning the piston driven actuator rod is introduced to or withdrawn from said cylinder on each side of the piston of said actuator rod.

3. The backhoe excavating apparatus as claimed in claim 2 wherein, the means associated with the closed end of the hydraulic cylinder of the actuator means for extending and retracting the telescoping members forming the improved dipper stick arm comprises a pair of hydraulic fluid lines one of which is in fluid communication with said cylinder through the closed end thereof for the introduction of hydraulic fluid to a first space between said closed end and the piston of said actuator rod and the withdrawal of hydraulic fluid from said first space and the other of which is in fluid communication with said cylinder through the annular space formed between the concentric walls of said cylinder and the ports at its actuator end for the introduction of hydraulic fluid to a second space between the piston of said actuator rod and the actuator end of said cylinder and the withdrawal of hydraulic fluid from said second space.

* * * * *